US006209342B1

(12) United States Patent
Banicevic et al.

(10) Patent No.: US 6,209,342 B1
(45) Date of Patent: Apr. 3, 2001

(54) REFRIGERATOR EVAPORATOR HOUSING

(75) Inventors: Nedo Banicevic, Hamilton; Murray Klaas, Burlington, both of (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/396,726

(22) Filed: Sep. 15, 1999

(30) Foreign Application Priority Data

Jan. 4, 1999 (CA) ..... 2257703

(51) Int. Cl.[7] ..... F25D 11/02
(52) U.S. Cl. ..... 62/443; 312/407
(58) Field of Search ..... 62/441, 443, 444, 62/447, 414, 419, 426; 312/407, 407.1

(56) References Cited

U.S. PATENT DOCUMENTS

| | | | | |
|---|---|---|---|---|
| 2,576,208 | * | 11/1951 | Benson | 62/444 |
| 3,320,761 | * | 5/1967 | Gelbard | 62/443 |
| 3,599,442 | | 8/1971 | Hanson | 62/419 |
| 3,766,976 | | 10/1973 | Gelbard et al. | 165/122 |
| 4,009,589 | | 3/1977 | Webb et al. | 62/180 |
| 4,075,866 | * | 2/1978 | Williamitis | 62/441 |
| 4,077,229 | | 3/1978 | Gelbard et al. | 62/283 |
| 4,211,090 | | 7/1980 | Gelbard et al. | 62/283 |
| 4,223,538 | | 9/1980 | Braden et al. | 62/443 |
| 4,543,799 | | 10/1985 | Horvay et al. | 62/283 |
| 4,704,874 | | 11/1987 | Thompson et al. | 62/187 |
| 4,944,157 | | 7/1990 | Jenkins et al. | 62/407 |
| 5,199,277 | | 4/1993 | Granstrom et al. | 62/298 |
| 5,263,535 | | 11/1993 | Philo et al. | 165/67 |

* cited by examiner

*Primary Examiner*—William E. Tapolcai

(57) ABSTRACT

A refrigerator cabinet has an exterior cabinet shell and a plastic liner insert defining a fresh food compartment and a freezer compartment where foamed in place insulation extends between the exterior cabinet shell and the interior liner. The liner has a partition with upper and lower walls extending rearwardly of a front mullion wall and between sidewalls of the liner. The upper sidewall has a cut-out recess adapted to receive an evaporator tray housing that is seated on edges of the upper wall of the partition. The tray supports an evaporator coil, motor, and fan. The tray has a cover that forms, together with the upper wall of the partition, the floor of the freezer compartment. By locating the evaporator tray recessed in the partition, in the partition space between the two compartments can be filled with rigid foam that extends between the upper and lower food compartments and to the exterior shell of the cabinet.

39 Claims, 8 Drawing Sheets

REFRIGERATOR EVAPORATOR HOUSING

FIELD OF THE INVENTION

The present invention relates to an evaporator housing for a refrigerator where the evaporator housing is recessed within the floor of the upper food storage compartment from a single liner. The present invention more specifically relates to a novel evaporator housing for use in a top mount or bottom mount refrigerator cabinet where the evaporator housing is held in place by foamed in place insulation as a portion of the partition wall between freezer and fresh food compartments.

BACKGROUND OF THE INVENTION

Many present day household refrigerators include a freezer compartment maintained at a below-freezing temperature for the storage of frozen foods and a fresh food compartment maintained at an above-freezing temperature for storage of fresh foods. In many such refrigerators, an evaporator for providing cooling for both the frozen food compartment and the fresh food compartment is positioned outside both compartments and air is circulated over the evaporator and then through the compartments to cool the compartments. The evaporator itself is maintained at a temperature substantially below freezing. In order to maintain the greatly differing temperatures required in the two compartments, a substantially greater portion of the air flowing over the evaporator is directed to the frozen compartment. The air flow over the evaporator and into the freezer and fresh food compartments is controlled by baffles that regulate or reduce the air flow into the fresh food compartment.

In some refrigerators, the evaporator is mounted behind a false partition rear wall in the freezer compartment. The construction of the evaporator behind a rear wall of freezer compartment is shown in U.S. Pat. No. 4,944,157 issued Jul. 31, 1990 to Jenkins et al, U.S. Pat. No. 4,704,874 issued Nov. 10, 1987 to Thompson et al and U.S. Pat. No. 4,077,229 issued Mar. 7, 1978 to Gelbard et al. In each of these patents the refrigerator cabinet has a single cavity liner positioned within an exterior metal shell and a mullion partition divider mounted between the freezer compartment and the fresh compartment. The divider is secured relative to the liner side walls and rear wall. The evaporator is housed behind the false partition wall above the mullion partition.

In other refrigerators, the evaporator is mounted in the partition inserted into the single cavity plastic liner secured relative to the side walls and rear wall of the plastic liner. The construction of the evaporator in the partition divider dividing the single cavity of the refrigerator liner into a freezer compartment and a fresh food compartment is shown in U.S. Pat. No. 3,559,442 issued Aug. 17, 1991 to Robert S. Hanson, U.S. Pat. No. 3,766,976 issued Oct. 23, 1973 to Gelbard et al, U.S. Pat. No. 4,211,090 issued to Gelbard et al, U.S. Pat. No. 4,223,538 issued Sep. 23, 1980 to Braden et al, and U.S. Pat. No. 4,543,799 issued to Oct. 1, 1985 to Horvay et al. While each of these patents locates the evaporator in the mullion partition divider between the fresh food compartment and the freezer compartment, the mullion partition is a separate component of the refrigerator cabinet that is inserted into the liner cavity of the refrigerator and secured relative to the rear and side walls of the liner. The mullion partition has a structural strength limitation that is dependent upon the mechanical fastening of the mullion partition to the rear and side walls of the liner cavity.

There is a need for an evaporator housing to be located within the partition wall between the freezer and fresh food compartments and forms a portion of the partition wall of the refrigerator and where the partition wall is integrally formed with the remainder of the rear and side wall of the refrigerator liner.

SUMMARY OF THE INVENTION

The present invention is directed to a refrigerator cabinet having an exterior cabinet shell and a plastic liner insert defining a fresh food compartment and a freezer compartment where foamed in place insulation extends between the exterior cabinet shell and the interior liner. The partition separating the fresh food compartment and the freezer compartment is filled with rigid insulation to provide a rigid structure. The present invention has a recessed evaporator housing in the partition between the freezer compartment and the fresh food compartment. The evaporator housing is inserted through an opening in the floor of the freezer compartment. This construction of the evaporator housing has the advantage associated with locating the evaporator in the space between the two compartments permitting for good air flow over the evaporator coils and into the freezer and fresh food compartments while at the same time enjoying the advantage associated with the rigid foam in place construction of the partition and liner to the exterior shell of the cabinet. It should be understood that the present invention has equal application in both top and bottom mount styles of refrigerator cabinets. That is refrigerator cabinets where the freezer is located respectively either above or below the fresh food compartment.

In accordance with an aspect of the present invention, there is provided a refrigerator cabinet comprising an exterior cabinet shell having a top wall, a rear wall, a bottom wall, side walls and an open front side. The cabinet includes an interior liner adapted to fit within the exterior cabinet shell and spaced therefrom by insulation. The interior liner has integrally formed therewith a partition which together define lower and upper food storage compartments. The partition includes a front mullion wall and spaced apart upper and lower walls extending generally horizontally and rearwardly of the front mullion wall within the plastic interior liner. The upper generally horizontal wall of the partition has an opening therein. The evaporator tray housing is recessed within the opening of the upper wall of the partition. The evaporator tray housing has a floor portion for supporting an evaporator coil, a motor and a fan blade connected to said motor. Insulation within cabinet further extends into the partition between the upper wall, the evaporator tray housing, the lower wall and the front mullion wall. The cabinet further includes a cover for overlaying the tray housing.

The evaporator tray housing preferably has tray side walls upstanding from the floor portion of which at least two of the tray side walls each includes an out-turned rim adapted to overlay a portion of the upper wall of the partition. The floor portion of the evaporator tray housing is spaced from the lower wall of the partition and the tray side walls are spaced from the mullion wall and the side walls of the exterior cabinet shell. The evaporator tray housing preferably includes a front upstanding wall having a hooked shaped flange that overlaps the mullion front wall to provide support on an additional surface.

BRIEF DESCRIPTION OF THE DRAWINGS

For a better understanding of the nature and objects of the present invention reference may be had by way of example to the accompanying diagrammatic drawings in which.

DETAILED DESCRIPTION OF PREFERRED EMBODIMENTS

Figure 1:
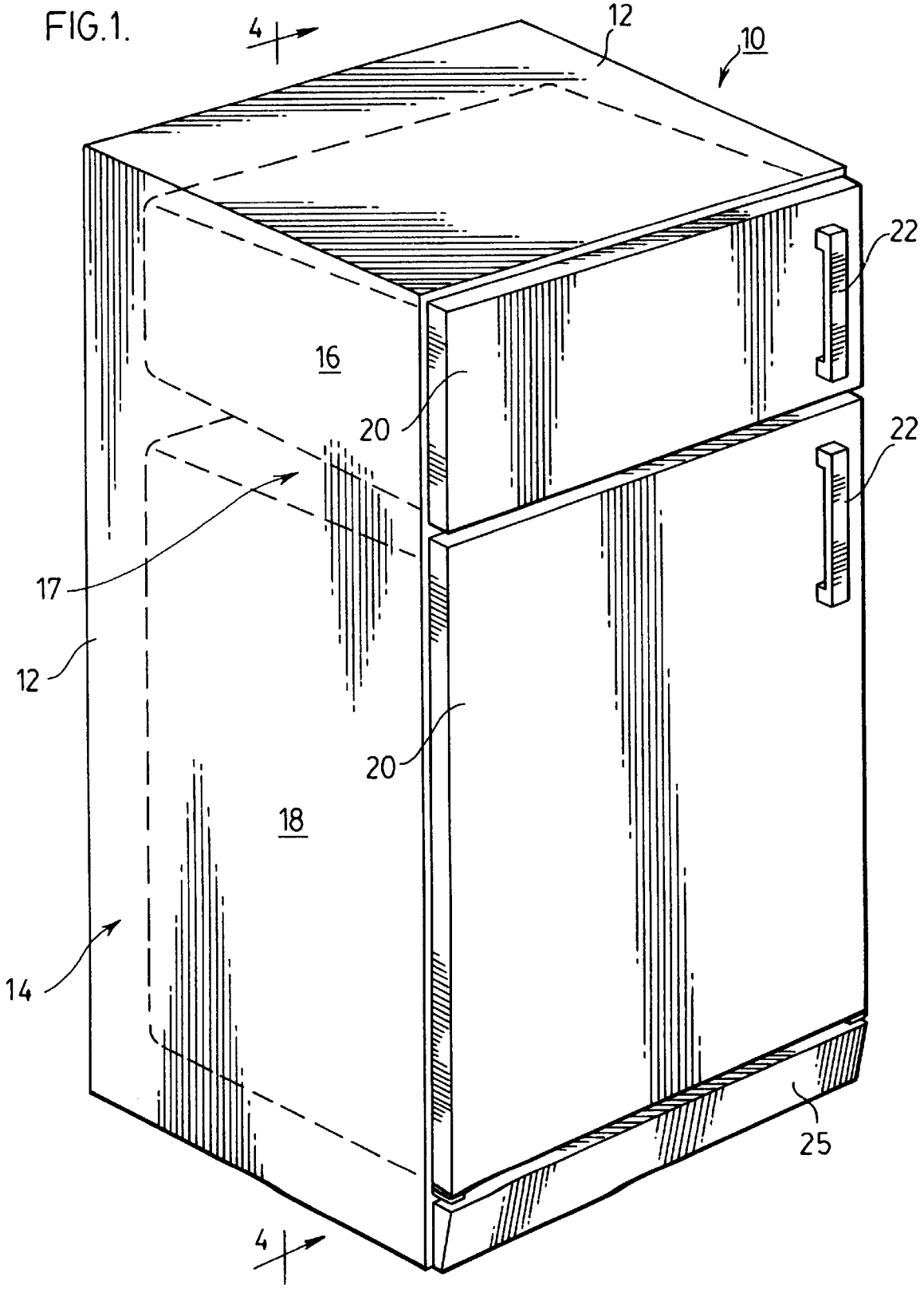
FIG. 1 is a perspective view of a top mount refrigerator.

Referring to FIG. 1, there is shown a refrigerator 10 having an exterior cabinet shell 12. The shell 12 is a thin sheet metal material. The refrigerator 10 includes an interior plastic liner 14. Interior liner 14 defines upper and lower food compartments 16 and 18 separated by a partition 17. The refrigerator cabinet 10 is a top mount refrigerator with the upper food compartment 16 is a freezer compartment and the lower food compartment 18 is a fresh food compartment. Access to the freezer compartment 16 and the fresh food compartment 18 is permitted at the front of the refrigerator 10 by opening doors 20. Doors 20 have handles 22 which facilitate opening of the doors 20. The bottom of the refrigerator 10 has a decorative kick plate 25. Wile the preferred embodiment of the present invention is for a top mount refrigerator 10, it should be understood that the invention alternatively may be used on a bottom mount refrigerator where the freezer compartment is located below the fresh food compartment.

Figure 2:
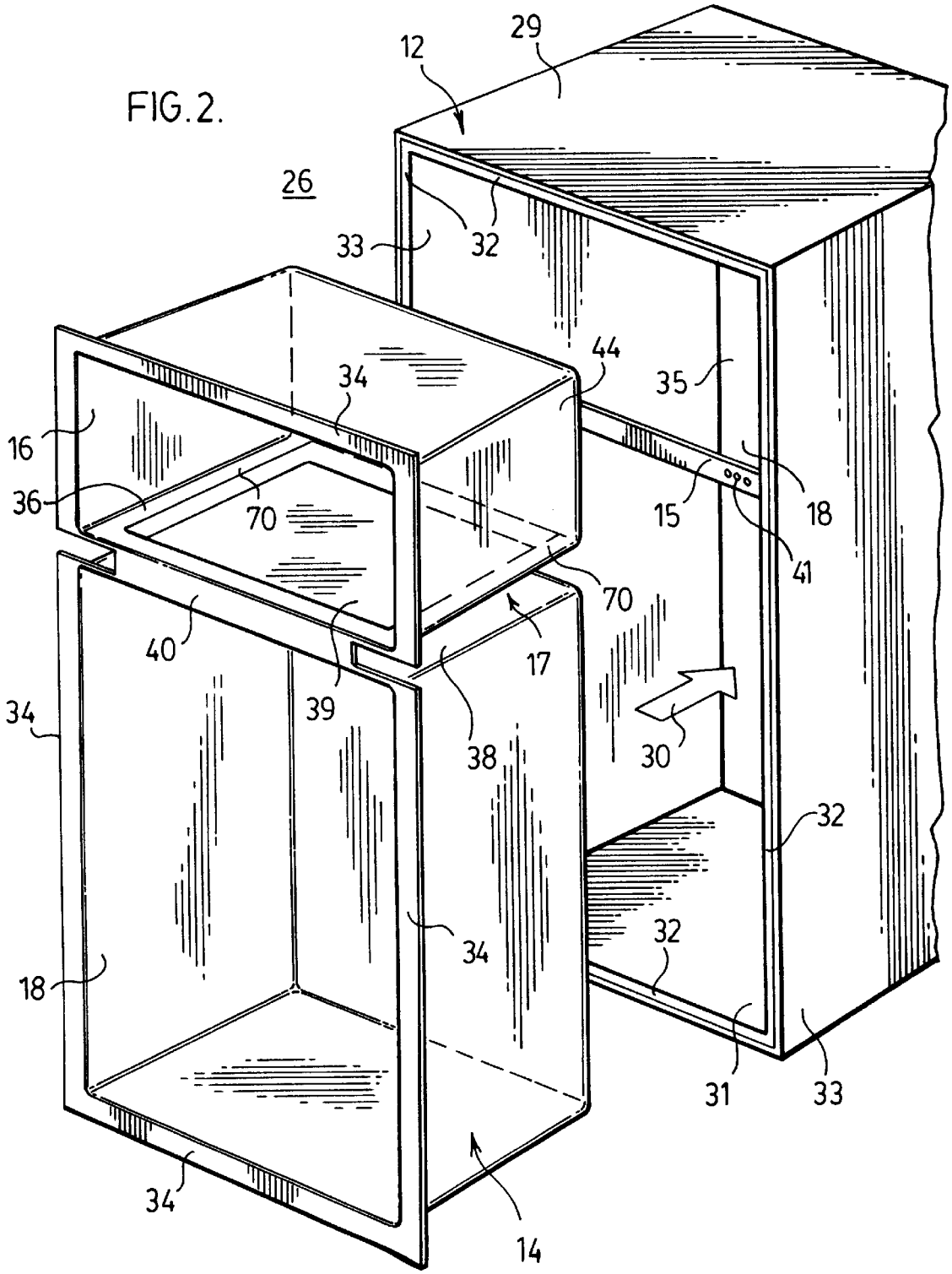
FIG. 2 is an exploded view of the refrigerator cabinet showing the interior plastic liner, the mullion strap and the exterior cabinet shell.

FIG. 2 is an exploded illustrative view of the cabinet 26 components. During manufacture the interior liner 14 is inserted into open side 28 of the exterior cabinet shell 12. This is represented by arrow 30. A metal mullion strap 15 is shown positioned in the exterior cabinet shell 12 behind the liner 14. Strap 15 extends across the open side 28 of the cabinet 26 inside partition 17.

The exterior cabinet shell 12 has a shell edge flange 32 extending around the open side of the top wall 29, bottom wall 31 and sidewalls 33 towards the opening of the open side 28. The exterior cabinet shell 12 is made from sheet metal and includes a rear wall 35.

The interior liner 14 is adapted to fit within the exterior cabinet shell 12. The interior liner 14 includes an outwardly extending liner flange 34. The liner 14 is a one-piece or uni-partite plastic material molded piece. A breaker strip (not shown) interconnects the liner flange 34 with the shell edge flange 32. The liner 14 further includes openings 41 through which hinges (not shown) extend for the mounting of the refrigerator doors 20.

The partition 17 separates the fresh food compartment 18 from the freezer compartment 16. The partition 17 includes an upper partition wall 36, a lower partition wall 38 and a front mullion wall 40. The upper and lower partition walls 36 and 38 are spaced apart by the front mullion wall 40. The upper and lower walls 36 and 38, extend generally horizontally and rearwardly of the front mullion wall 40. Preferably the walls 36 and 38 are angled slightly. The bottom partition wall is the upper wall of the lower food compartment 18 and the top partition wall 36 is the lower liner wall of the upper freezer compartment 16. The upper partition wall 36 has an enlarged central opening 39. Opening 39 is located rearwardly of the mullion wall 40 and extends back to the rear wall 44 of the upper food compartment 16 of the liner 14. It is into opening 39 that the evaporator tray housing 46 of the present invention is seated in a recessed manner.

Figure 3:
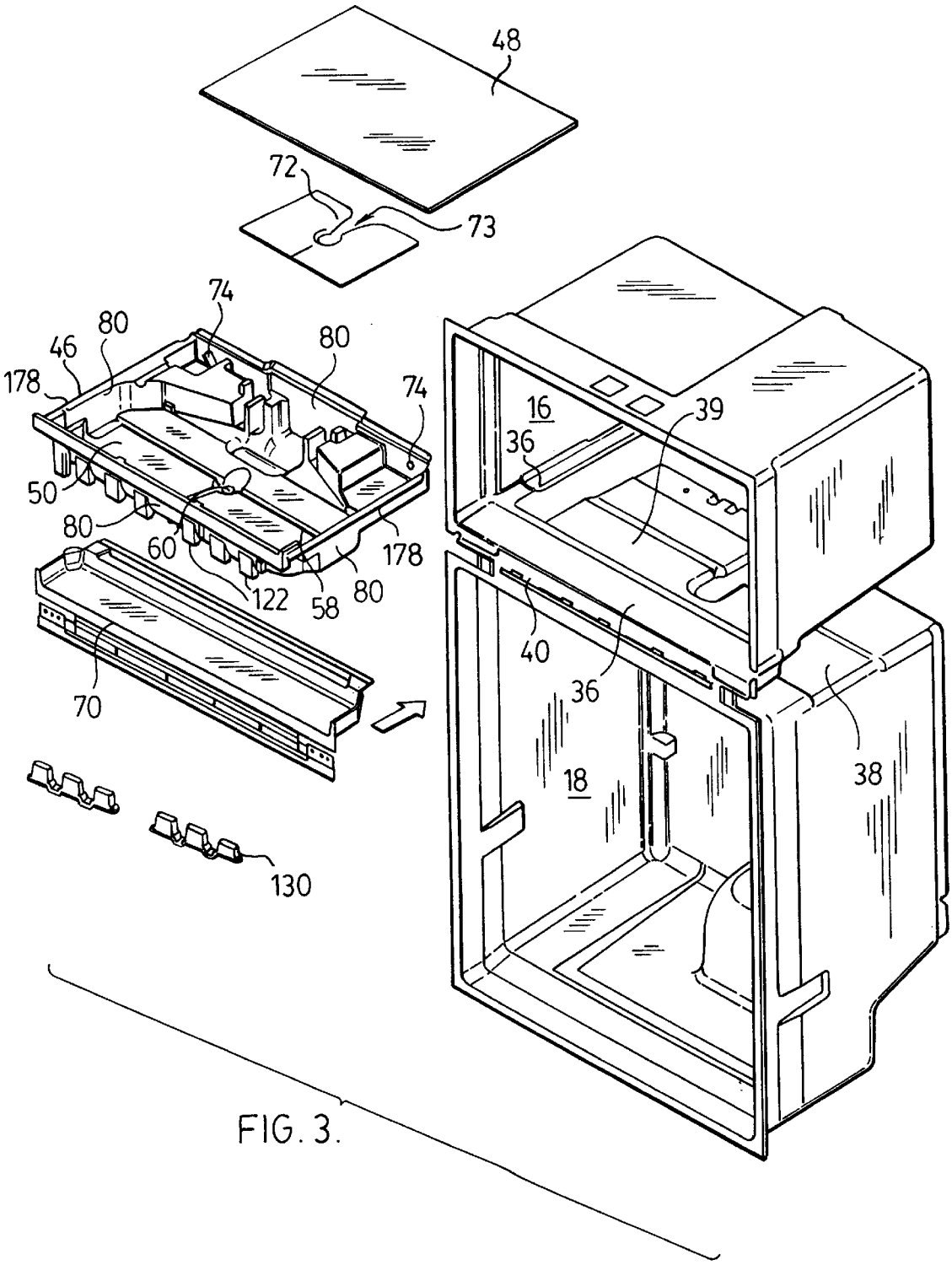
FIG. 3 an exploded perspective view showing the details of the construction of the evaporator housing relative to the interior plastic liner of the refrigerator cabinet.
Figure 4:
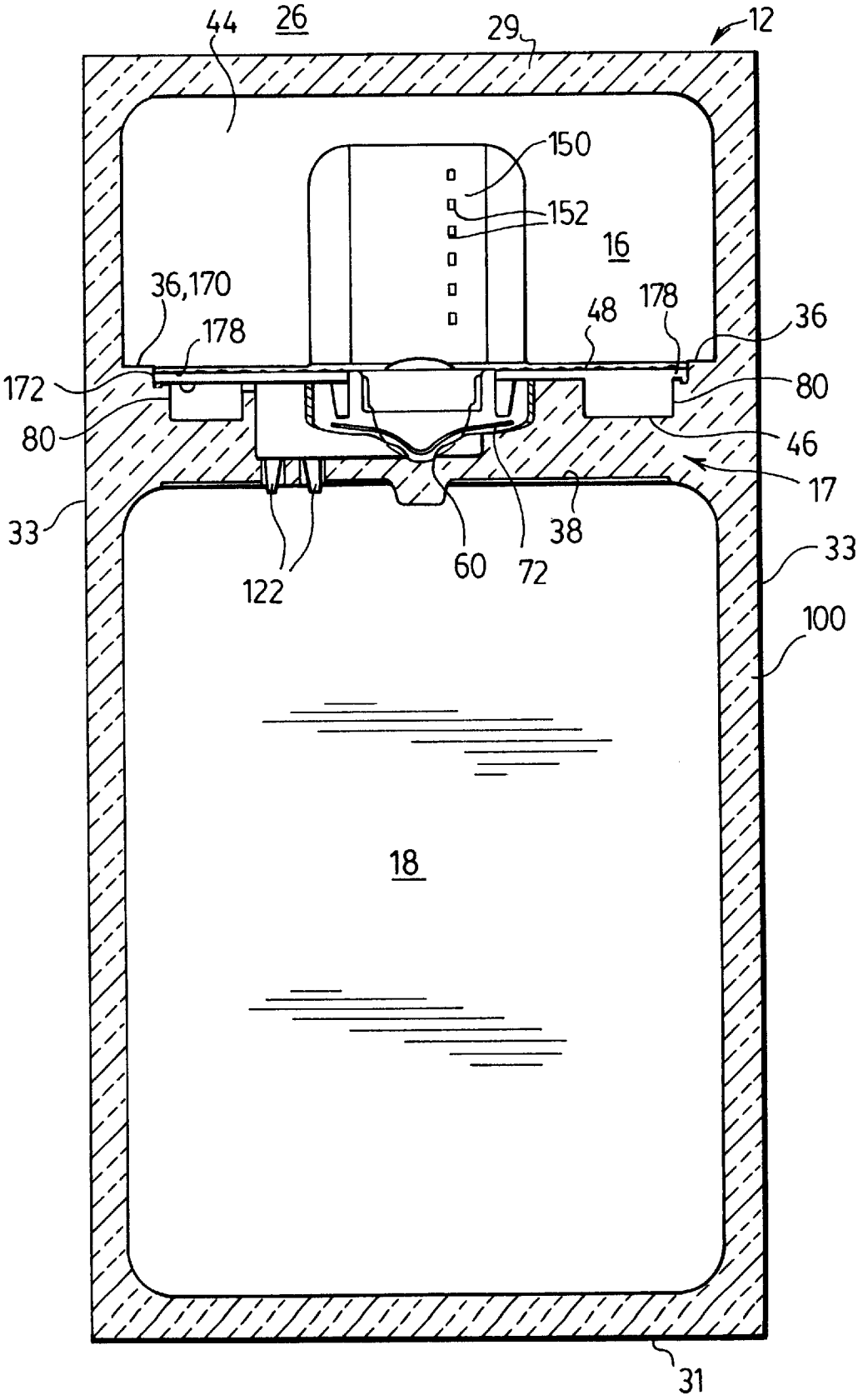
FIG. 4 is a front sectional view taken along lines 4—4 of FIG. 1 showing the evaporator tray housing located within the refrigerator cabinet.
Figure 5:
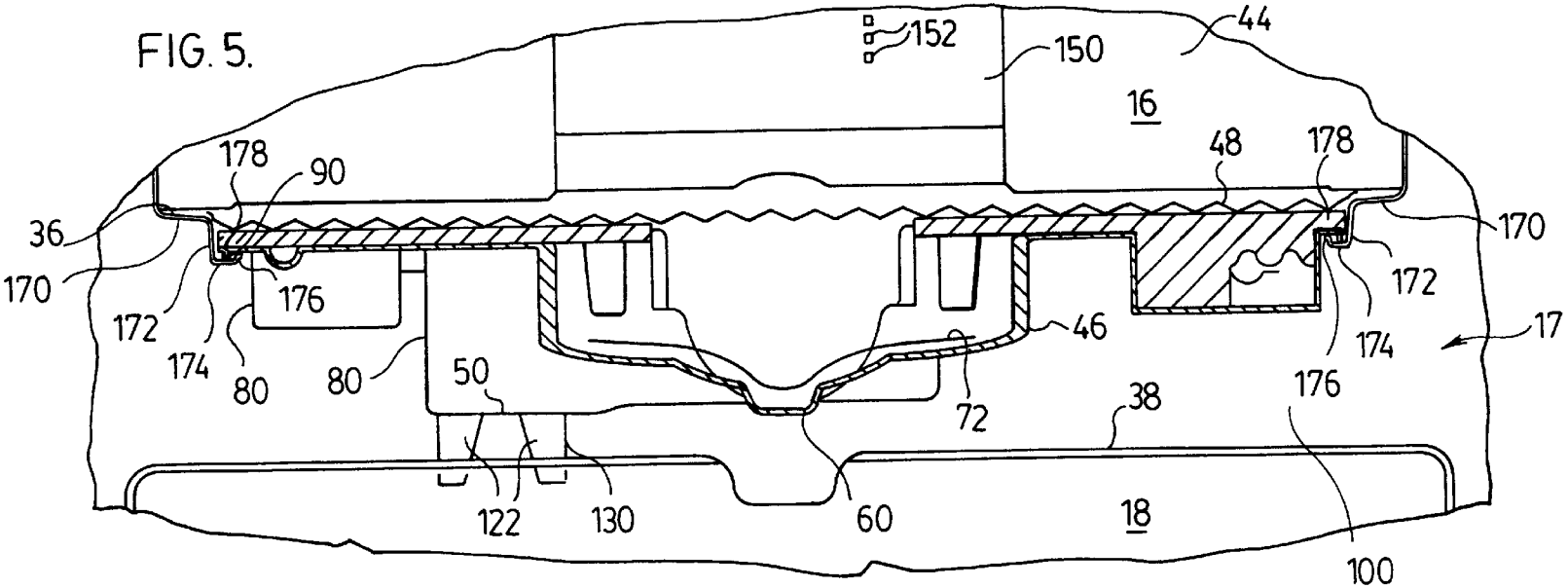
FIGS. 5 and 6 are enlarged partial views of FIG. 4 for the evaporator tray housing.
Figure 6:
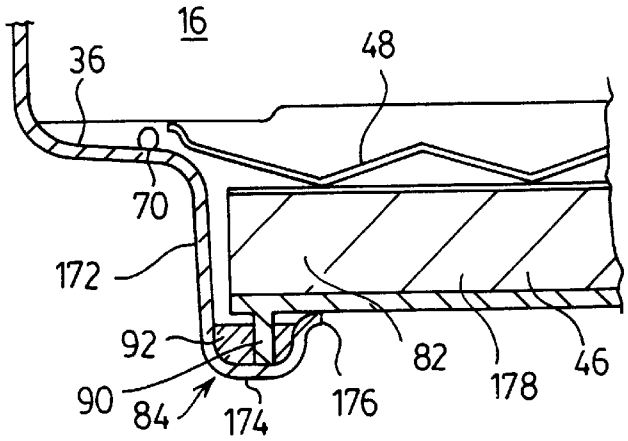
Figure 7:
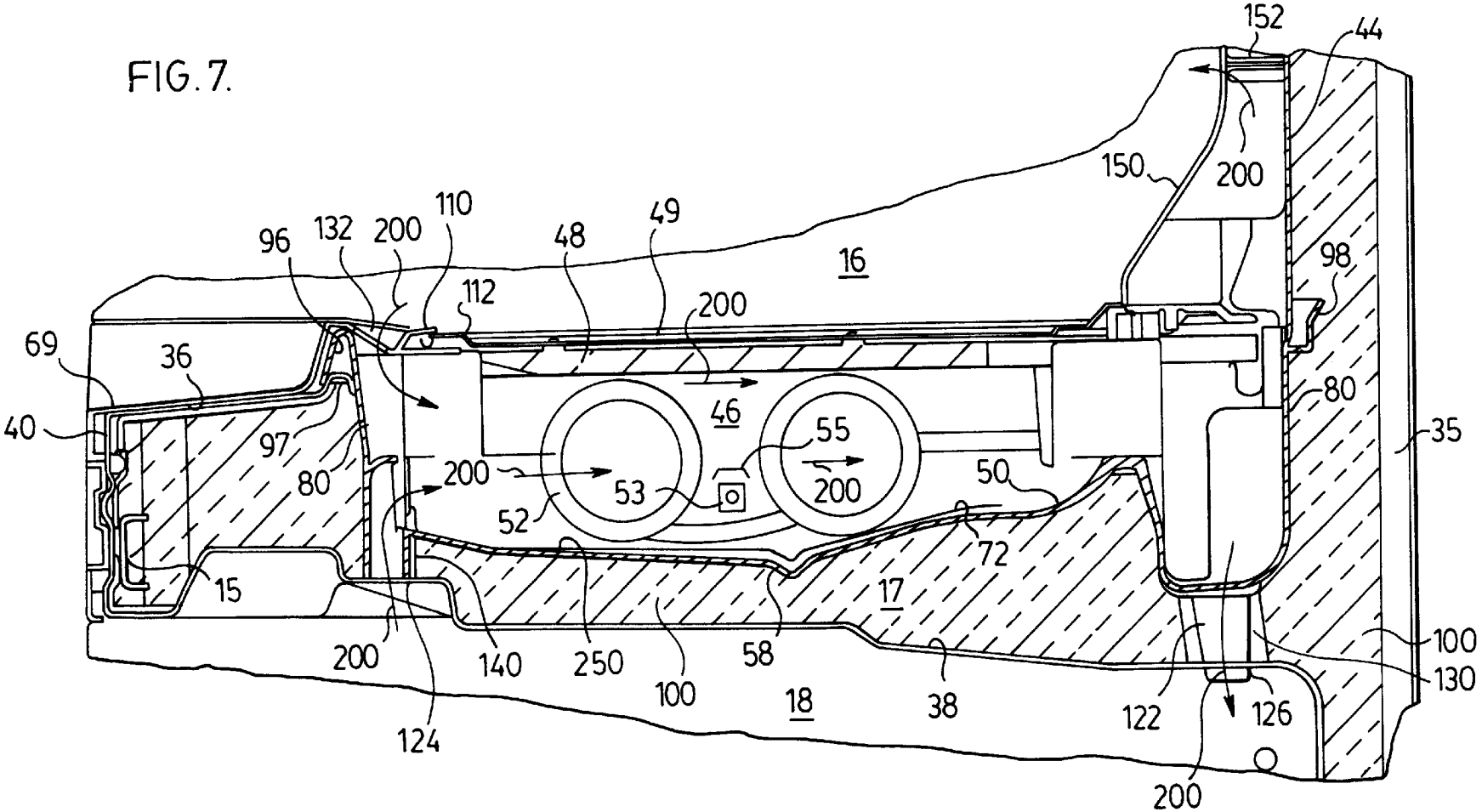
FIG. 7 is a side sectional view showing the evaporator housing located in the refrigerator cabinet between the fresh food compartment and the freezer compartment.
Figure 8:
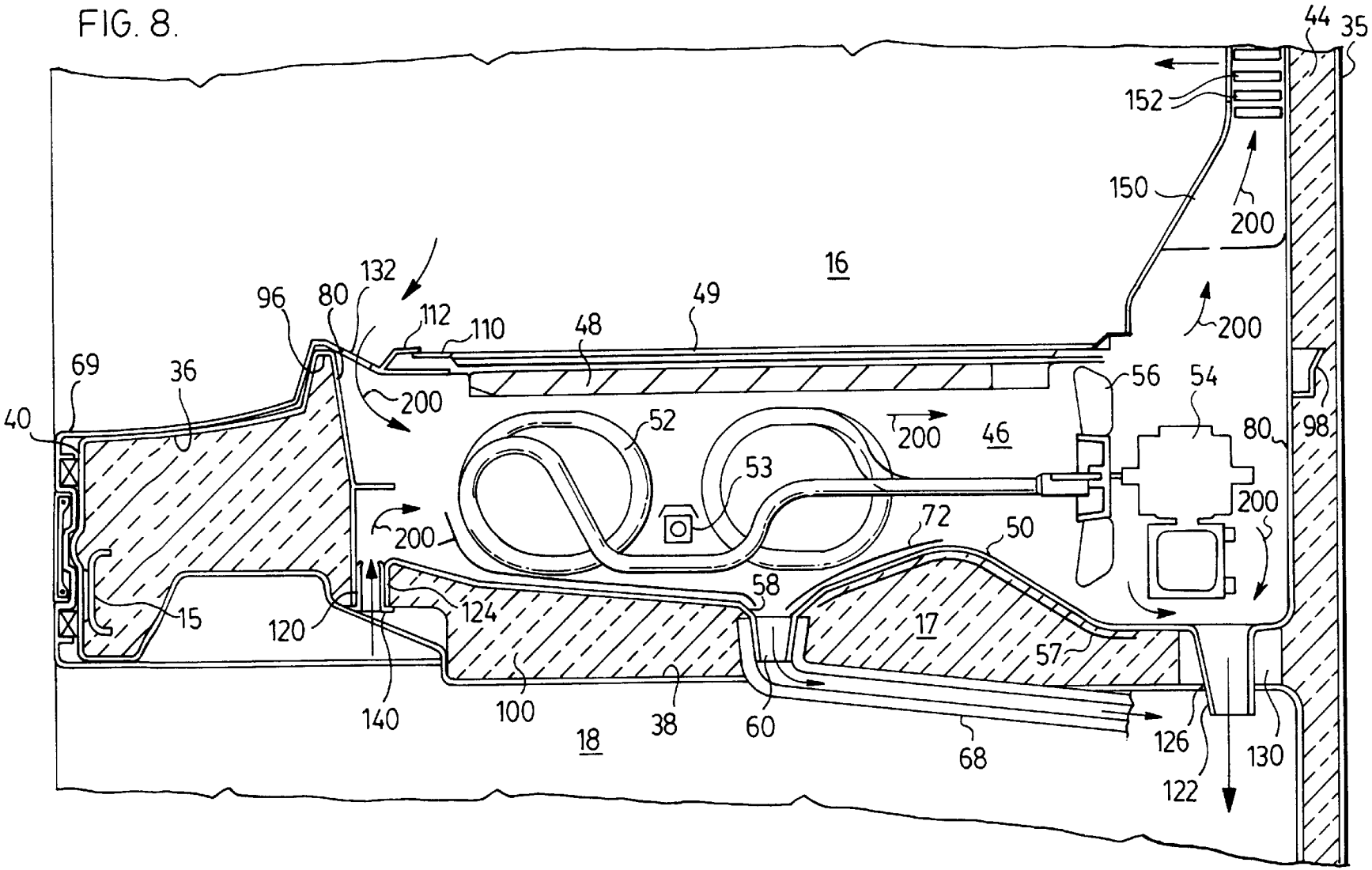
FIG. 8 is a side sectional view similar to FIG. 7, where the section is taken through passage air inlets and the drain tube is located inside the fresh food compartment.
Figure 9:
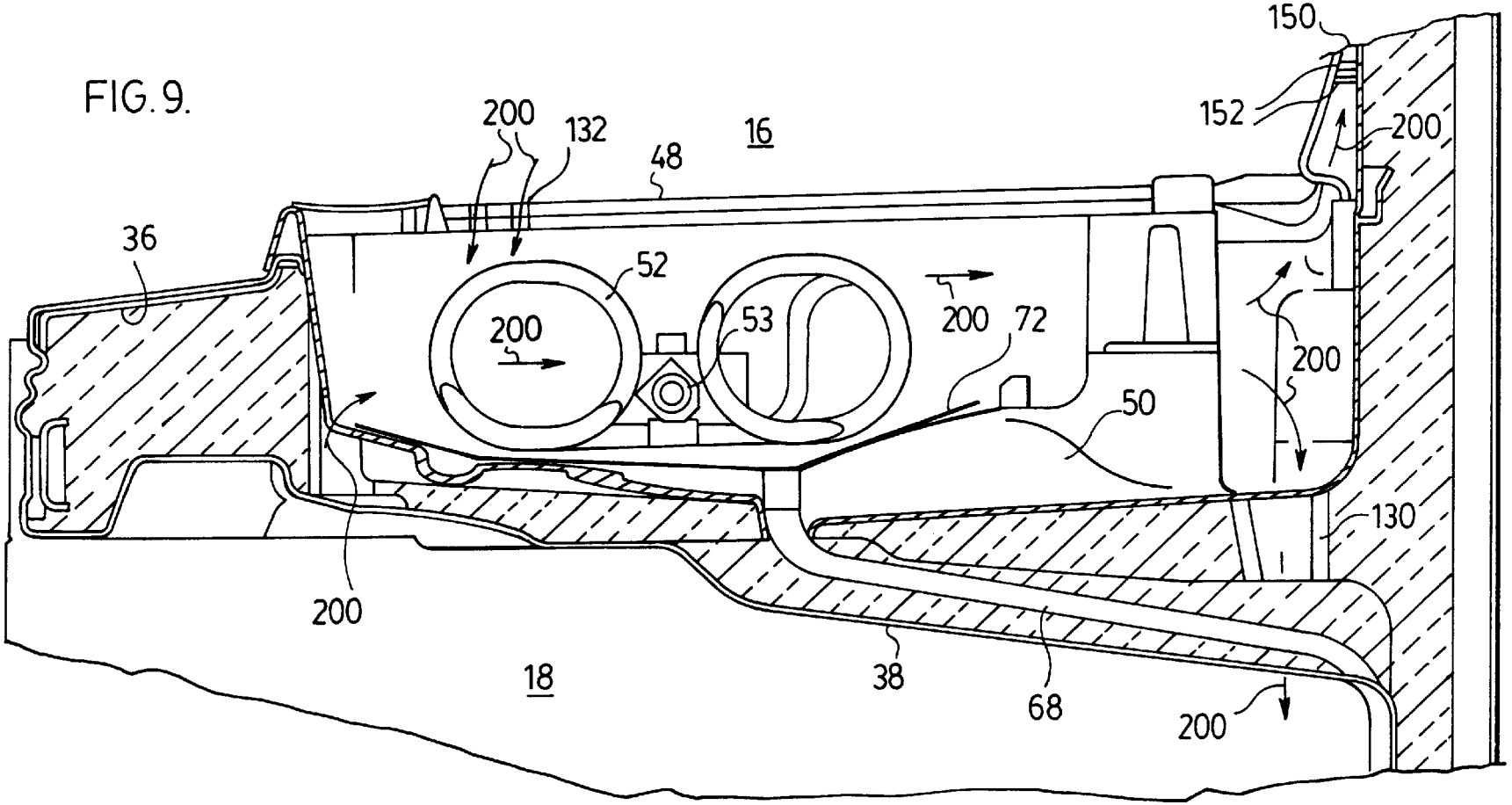
FIG. 9 is a side sectional view similar to FIG. 8 showing the most preferred embodiment with the air inlet passage from the upper compartment extending through the mullion grill and the drain tube located within the partition wall.

Referring now to FIGS. 3 through 9, the construction of the evaporator tray housing 46 for different preferred embodiments of the present invention with respect to the refrigerator cabinet is shown. In FIG. 3, a preferred construction for the evaporator tray housing 46 relative to the liner is shown. FIG. 4 is illustrative of the preferred tray housing 46 construction relative to the refrigerator liner 14 and the shell 12 of the refrigerator cabinet. FIG. 5 is an exploded view in more detail the relationship between the evaporator tray housing 46 and the interior liner 14 of the present invention. FIGS. 7 to 9 are cross-sectional views showing in detail the placement of the tray housing 46 relative to the interior liner 14.

The evaporator tray housing 46 includes a tray cover 48. The tray 46 has a floor portion 50 contoured to support evaporator coil 52, motor 54 and fan blade 56 (see FIG. 8). The floor portion 50 is further provided with moisture runoff groove 58 and drain hole 60 connected to drain tubing 68 back through an opening in the lower partition wall 38 as shown in FIG. 8.

In FIG. 9, the drain tube is located within partition 17 above the lower partition wall. The drain tubing 68 permits water to drain from the evaporator tray housing 46 when a defrost cycle for the refrigerator is initiated. During a defrost cycle, any frost build up on the evaporator coils is melted.

In accordance with the present invention the evaporator tray housing 46 is seated on the upper partition wall 36 recessed within the space of the partition 17. After the insertion of the tray 46 into the freezer or upper freezer compartment 16, a decorative grill 69 is secured on and over the mullion front wall 40, the front portion of the top liner wall 36 and an edge portion of the tray 46. A metallic plate or pan 72 is laid on the floor portion 50 of the tray housing 46. The evaporator coil 52, fan blade 56, defrost heater 53 and motor 54 are assembled within the tray housing and suitable wiring extends through openings 74 located in a rear wall of the tray housing 46 (see FIG. 3). The cover 48 is placed over the tray housing 46 to close the evaporator tray 46 recessed within the partition 17. A freezer floor plate 49 overlaps the cover 48.

The metallic pan 72 is contoured to follow the shape of the floor portion 50 of the tray housing 46. The pan 72 protects the plastic floor portion 50 by evenly dissipating heat generated from the evaporator coils during the defrost cycle and by preventing over-heating of plastic housing 46. The plate 72 also drains water from underneath the evaporator coil to hole 60. The pan 72 further includes a rear cut-out section 73 that allows heat transfer from the defrost heater 53 into the areas adjacent the fan blade 56, the motor 54 and the drain area 58. The defrost heater 53 is placed amongst coils 52 and is activated to accelerate the melting of frost during a defrost cycle. The heater 53 includes a metal shield cover 55 that deflects radiant heat away from the plastic cover 48. Optionally, as shown in FIG. 8, an aluminum foil 57 with a drain heater attached is placed below the floor 50 of the tray housing 46 adjacent the fan blade 56 and motor 54. The aluminum foil drain heater 57 is activated during a defrost cycle to prevent ice formation during and after the defrost cycle in the drain area 58 and the area of the fan blade 56.

Referring to FIGS. 4 to 6, the preferred constructions of the evaporator tray housing 46 within the partition 17 is described. The upper partition wall 36 has two elongated edges 70 that extend along the sides of the opening 39. As best seen in FIG. 6, each of the edges 70 includes a depressed apron 172 extending downwardly from the upper wall 36 of the partition 17. The depressed apron 172 further includes an in-turned flange 174 that extends from the apron 172 into the opening 39. The in-turned flange 174 is a hook shape having an edge lip 176.

The evaporator tray housing 46 includes at least two out-turned rib portions 178 extending outwardly from tray upstanding wall 80. The out-turned ribs 178 are adapted to overlie a corresponding one of the in-turned flanges 174 of the upper wall 36 of the partition 17. The floor portion 50 of the evaporator tray housing 46 is thus spaced from the bottom wall 38 of the partition 17 and the tray side walls 80 are spaced from the partition mullion wall 40 and the side walls 33 of the exterior cabinet shell 18. Each of the out-turned rims 178 of the evaporator tray housing 46 has a downwardly depending rib 90 that rests on a corresponding in-turned flange 174 of the upper wall 36 of the partition 17. The out-turned rims 178 of the evaporator tray housing 46 are shown with the downwardly extending rib 90 resting on the in-turned flange 74 between the apron 172 and the edge lip 176 of the edge 70 of the partition 17. The out-turned rims 178 further include a sealing spacer gasket member 92 which is attached either to the rim 90 or to the apron 172. This allows for a close fit of the tray 46 within the opening 39 of the partition 17 and seals to prevent insulation from leaking into the open area 16.

Referring to FIG. 7, the evaporator tray housing front wall 80 has a hooked shape flange 96 that hooks over the forward wall or forward portion 97 of the upper wall 36 of partition provided immediately behind the mullion wall 40 to seat the tray 46 relative to the front of upper wall 36. The evaporator tray 46 further includes an upstanding rear wall 80 which has a hook portion 98 into which the rear wall 44 of the liner is hooked into place.

The cover 48 of the evaporator tray housing 46 is press fitted into the tray housing 46 and over the evaporator coils 52. The freezer floor plate 49 has an edge portion 112 with a hooked that is held recessed groove 110 forming a rear extension from the mullion grill 69. The freezer floor plate 49 also slides into engagement with the back wall of the freezer compartment and is secured relative to upper partition wall 36 by fastening screws (not shown).

Referring to FIGS. 7 to 9, side cross-sectional views of the tray housing 46, tray cover 48 evaporator coils 52, and the airflow through the housing 46 are shown. The primary difference between the embodiment of FIG. 8 and the preferred embodiment of FIG. 9 is that the drain tube 68 of FIG. 9 is located within the partition 17 whereas the drain tube 68 of FIG. 8 is located within the fresh food compartment 18.

In FIGS. 7 to 9, the airflow through housing 46 is depicted by arrows 200. Motor 54 is activated to drive fan 56 which creates the airflow 200 through the evaporator tray housing 46. Air 200 is cooled as it passes over the evaporator coils 52.

The evaporator tray housing 46 has at least one lower inlet passage 120 and at least one lower outlet passage 122 extending through corresponding openings 124 and 126 in the lower wall 38 of the partition 17 to permit the air flow between the lower food compartment 18 and through the evaporator tray housing 46. Additional supporting spacers 130 interconnect the lower air inlet passage and the lower air outlet passages with the corresponding lower partition wall 38. Spacers 130 further support the evaporator tray housing 46 recessed within the partition 17 and prevent the escape of insulation from the partition 17 into the lower food compartment 18.

For air circulation into the upper food compartment 16, the lower wall 38 has a plurality of openings 140 (FIG. 9) and the grill 70 has openings 132 (FIG. 8) located adjacent the front mullion wall 40. The refrigerator cabinet further includes a vent stack 150 extending upwardly from the evaporator tray housing 46 behind the cover 48 and over the interior liner rear wall 44. The vent stack 150 includes a plurality of air outlet openings 152 that permit the air flow between the upper food compartment 16 and the evaporator tray housing 46 in through the cover inlet openings and out through the vent openings.

As best seen in FIGS. 4, 5, and 7 to 9, the upstanding sidewalls 80 of the tray 46 are surrounded by foam in place insulation 100. The rigid insulation 100 is blown into the space between the liner 14 and the walls of the exterior cabinet shell 12. The foam 100 during curing expands to fill voids between the freezer compartment 16 and the fresh food compartment 18 and thereby rigidly hold the evaporator tray housing 46 recessed within the partition 17. The foam 100 extends from the sidewalls 33 of the exterior cabinet shell 12 around the liner 14 and across the partition 17 between the food compartments 16 and 18. Further, the use of the spacers or grommets 130 at the air outlets, and the overlapping and sealing relationship between the out-turned rims 90 of the tray 46, the in-turned flanges 174 of the freezer floor 36 and the sealing gasket member 92 prevent foam insulation from leaking into the evaporator tray housing 16.

What is claimed is:

1. A refrigerator cabinet comprising:

(a) an exterior cabinet shell having a top wall, a rear wall, a bottom wall, side walls and an open front side;

(b) an interior liner adapted to fit within the exterior cabinet shell and spaced therefrom by insulation, said interior liner having integrally formed therewith a partition which together define lower and upper food storage compartments, the partition including a front mullion wall and spaced apart upper and lower walls extending generally horizontally and rearwardly of the front mullion wall within the plastic interior liner, the upper generally horizontal wall of the partition having an opening therein, (c) an evaporator tray housing recessed within the opening of the upper wall of the partition, the evaporator tray housing having a floor portion for supporting an evaporator coil a motor and a fan blade connected to said motor, the evaporator tray housing having tray side walls upstanding from the floor portion of which at least two of the tray side walls each includes an out-turned rim adapted to overlay a portion of the upper wall of the partition, the floor portion of the evaporator tray housing being spaced from the lower wall of the partition and the tray side walls being spaced from the front mullion wall and the side walls of the exterior cabinet shell, and the insulation further extending into the partition between the upper wall, the evaporator tray housing the lower wall and the front mullion; and, (d) a cover for overlaying the tray housing.

2. The refrigerator cabinet of claim 1 wherein the evaporator tray housing includes a front upstanding wall having a flange that overlaps the front mullion wall.

3. The refrigerator cabinet of claim 1 wherein the opening in the upper wall of the partition is spaced rearwardly of the front mullion wall.

4. The refrigerator cabinet of claim 1 wherein the upper wall of the partition has at least two opposing edges extending along the opening each including a depressed apron and an in-turned flange extending from the apron into the opening, and each of the out-turned rims is adapted to overlay a corresponding one of the in-turned flanges of the upper wall of the partition.

5. The refrigerator cabinet of claim 4 wherein each of the out-turned rims of the evaporator tray housing includes a downwardly depending rib that rests on the corresponding in-turned flange of the upper wall of the partition.

6. The refrigerator cabinet of claim 5 further including a sealing gasket member positioned between the depending rib and the in-turned flange.

7. The refrigerator cabinet of claim 4 wherein each of the in-turned flanges is hooked and has an edge lip that supports the out-turned rim of the evaporator tray housing.

8. The refrigerator cabinet of claim 7 wherein each of the out-turned rims of the evaporator tray housing includes a downwardly depending rib that rests on the corresponding in-turned flange of the upper wall of the partition between the apron and the edge lip.

9. The refrigerator cabinet of claim 8 further including a sealing gasket member positioned between the depending rib and the in-turned flange.

10. The refrigerator cabinet of claim 8 wherein the evaporator tray housing includes a front upstanding wall having a hooked shaped flange that overlaps the mullion front wall.

11. The refrigerator cabinet of claim 8 wherein the evaporator tray housing includes an upstanding rear wall that attaches to a rear wall of the plastic interior liner.

12. The refrigerator cabinet of claim 1 wherein the cover includes a plurality of air inlet openings adjacent the front mullion wall, and the refrigerator cabinet further includes a vent stack extending upwardly from the evaporator tray housing behind the cover and over the interior liner rear wall into the upper food compartment, the vent stack includes a plurality of air outlet openings permitting air flow between the upper food compartment and the evaporator tray housing in through the cover inlet openings and out through the vent outlet openings.

13. The refrigerator cabinet of claim 4 wherein the evaporator tray housing further includes a metallic pan positioned on the floor portion and on which the evaporator coil is located.

14. The refrigerator cabinet of claim 13 wherein the evaporator tray housing further includes a defrost heater positioned on the metallic pan to heat the evaporator coils during a defrost cycle.

15. The refrigerator cabinet of claim 13 wherein the metallic pan has a rearwardly positioned cut out portion adjacent the fan blade.

16. The refrigerator cabinet of claim 4 further including a heater foil located below the floor of the tray housing adjacent the fan blade.

17. The refrigerator cabinet of claim 14 further including a heater foil located below the floor of the tray housing adjacent the fan blade.

18. A refrigerator cabinet comprising:

(a) an exterior cabinet shell having a top wall, a rear wall, a bottom wall, side walls and an open front side;

(b) an interior liner adapted to fit within the exterior cabinet shell and spaced therefrom by insulation, said interior liner having integrally formed therewith a partition which together define lower and upper food storage compartments, the partition including a front mullion wall and spaced apart upper and lower walls extending generally horizontally and rearwardly of the front mullion wall within the plastic interior liner, the upper generally horizontal wall of the partition having an opening therein, (c) an evaporator tray housing recessed within the opening of the upper wall of the partition, the evaporator tray housing having a floor portion for supporting an evaporator coil, a motor and a fan blade connected to said motor, and the insulation further extending into the partition between the upper wall, the evaporator tray housing, the lower wall and the front mullion;

(d) a cover for overlaying the tray housing; and, (e) the front mullion wall having a grill that extends rearwardly to support the cover.

19. The refrigerator cabinet of claim 18 wherein the cover includes a plurality of air inlet openings adjacent the front mullion wall to permit air flow from the upper food compartment into the evaporator tray.

20. The refrigerator cabinet of claim 19 wherein the refrigerator cabinet further includes a vent stack extending upwardly from the evaporator tray housing behind the cover and over the interior liner rear wall into the upper food compartment, the vent stack includes a plurality of air outlet openings permitting air flow between the upper food compartment and the evaporator tray housing in through the cover inlet openings and out through the vent outlet openings.

21. The refrigerator cabinet of claim 18 wherein the grill includes a plurality of air inlet openings adjacent the front mullion wall permitting air flow from the upper food storage compartment into the evaporator tray housing.

22. The refrigerator cabinet of claim 21 wherein the refrigerator cabinet further includes a vent stack extending upwardly from the evaporator tray housing behind the cover and over the interior liner rear wall into the upper food compartment, the vent stack includes a plurality of air outlet openings permitting air flow between the upper food compartment and the evaporator tray housing in through the grill inlet openings and out through the vent outlet openings.

23. The refrigerator cabinet of claim 20 wherein the floor portion of the evaporator tray housing includes at least one lower air inlet passage and at least one lower air outlet passage extending through corresponding opening in the lower wall of the partition to permit air flow between the lower food compartment and the evaporator tray housing.

24. The refrigerator cabinet of claim 22 wherein the floor portion of the evaporator tray housing includes at least one lower air inlet passage and at least one lower air outlet passage extending through corresponding opening in the lower wall of the partition to permit air flow between the lower food compartment and the evaporator tray housing.

25. The refrigerator cabinet of claim 18 wherein the evaporator tray housing further includes a metallic pan positioned on the floor portion and on which the evaporator coil is located.

26. The refrigerator cabinet of claim 25 wherein the evaporator tray housing further includes a defrost heater positioned on the metallic pan to heat the evaporator coils during a defrost cycle.

27. The refrigerator cabinet of claim 14 wherein the metallic pan has a rearwardly positioned cut out portion adjacent the fan blade.

28. A refrigerator cabinet comprising:

(a) an exterior cabinet shell having a top wall, a rear wall, a bottom wall, side walls and an open front side;

(b) an interior liner adapted to fit within the exterior cabinet shell and spaced therefrom by insulation, said interior liner having integrally formed therewith a partition which together define lower and upper food storage compartments, the partition including a front mullion wall and spaced apart upper and lower walls extending generally horizontally and rearwardly of the front mullion wall within the plastic interior liner, the upper generally horizontal wall of the partition having an opening therein;

(c) an evaporator tray housing recessed within the opening of the upper wall of the partition, the evaporator tray housing having a floor portion for supporting an evaporator coil, a motor and a fan blade connected to said motor, the insulation further extending into the partition between the upper wall, the evaporator tray housing, the lower wall and the front mullion, and the floor portion of the evaporator tray housing having at least one lower air inlet passage and at least one lower air outlet passage extending through corresponding opening in the lower wall of the partition to permit air flow between the lower food compartment and the evaporator tray housing;

(d) a cover for overlaying the tray housing; and, (e) supporting spacers interconnecting the lower air inlet passage and the lower air outlet passage with the corresponding lower partition wall openings to further support the evaporator tray housing recessed in the partition and to prevent escape of insulation from the partition into the lower food compartment.

29. The refrigerator of claim 28 wherein the lower inlet and the lower outlet passages are integrally formed from a floor portion of evaporator tray housing.

30. A refrigerator cabinet comprising:

(a) an exterior cabinet shell having a top wall, a rear wall, a bottom wall, side walls and an open front side;

(b) an interior liner adapted to fit within the exterior cabinet shell and spaced therefrom by insulation, said interior liner having integrally formed therewith a partition which together define lower and upper food storage compartments, the partition including a front mullion wall and spaced apart upper and lower walls extending generally horizontally and rearwardly of the front mullion wall within the plastic interior liner, the upper generally horizontal wall of the partition having an opening therein;

(c) an evaporator tray housing recessed within the opening of the upper wall of the partition, the evaporator tray housing having a floor portion for supporting an evaporator coil, a motor and a fan blade connected to said motor, the insulation further extending into the partition between the upper wall, the evaporator tray housing, the lower wall and the front mullion, the floor portion of the evaporator tray housing having at least one lower air inlet passage and at least one lower air outlet passage extending through corresponding opening in the lower wall of the partition to permit air flow between the lower food compartment and the evaporator tray housing, and the evaporator tray housing having an upstanding rear wall that attaches to a rear wall of the plastic interior liner; and (d) a cover for overlaying the tray housing.

31. The refrigerator cabinet of claim 30 wherein the front mullion wall includes a grill that extends rearwardly to support the cover, and the grill includes a plurality of air inlet openings adjacent the front mullion wall, and the refrigerator cabinet further includes a vent stack extending upwardly from the evaporator tray housing behind the cover and over the interior liner rear wall into the upper food compartment, the vent stack includes a plurality of air outlet openings permitting air flow between the upper food compartment and the evaporator tray housing in through the grill inlet openings and out through the vent outlet openings.

32. The refrigerator cabinet of claim 31 wherein the upper wall of the partition has at least two opposing edges extending along the opening each including a depressed apron and an in-turned flange extending from the apron into the opening, and the evaporator tray housing including at least tray two side walls upstanding from the floor portion each with an out-turned rim adapted to overlay a corresponding one of the in-turned flanges of the upper wall of the partition, the floor portion of the evaporator tray housing being spaced from the lower wall of the partition and the tray side walls being spaced from the mullion wall and the side walls of the exterior cabinet shell.

33. The refrigerator cabinet of claim 32 wherein each of the out-turned rims of the evaporator tray housing includes a downwardly depending rib that rests on the corresponding in-turned flange of the upper wall of the partition.

34. The refrigerator cabinet of claim 32 wherein each of the in-turned flanges is hooked and has an edge lip that supports the out-turned rim of the evaporator tray housing.

35. The refrigerator cabinet of claim 34 wherein each of the out-turned rims of the evaporator tray housing includes a downwardly depending rib that rests on the corresponding in-turned flange of the upper wall of the partition between the apron and the edge lip.

36. The refrigerator cabinet of claim 33 further including a sealing gasket member positioned between the depending rib and the in-turned flange.

37. The refrigerator cabinet of claim 36 wherein the evaporator tray housing includes a front upstanding wall having a hooked shaped flange that overlaps the mullion front wall.

38. The refrigerator cabinet of claim 37 wherein the evaporator tray housing further includes a metallic pan positioned on the floor portion and on which the evaporator coil is located.

39. The refrigerator cabinet of claim 38 wherein the evaporator tray housing further includes a defrost heater positioned on the metallic pan to heat the evaporator coils during a defrost cycle.

* * * * *